US011791119B2

(12) United States Patent
Miyake et al.

(10) Patent No.: US 11,791,119 B2
(45) Date of Patent: Oct. 17, 2023

(54) RELAY

(71) Applicant: OMRON Corporation, Kyoto (JP)

(72) Inventors: Ayaka Miyake, Kikuchi (JP); Koichiro Matsushima, Kumamoto (JP); Yuji Kozai, Kyoto (JP); Taira Minamizaki, Koshi (JP)

(73) Assignee: OMRON CORPORATION, Kyoto (JP)

( * ) Notice: Subject to any disclaimer, the term of this patent is extended or adjusted under 35 U.S.C. 154(b) by 215 days.

(21) Appl. No.: 17/429,627

(22) PCT Filed: Feb. 12, 2020

(86) PCT No.: PCT/JP2020/005264
§ 371 (c)(1),
(2) Date: Aug. 10, 2021

(87) PCT Pub. No.: WO2020/170900
PCT Pub. Date: Aug. 27, 2020

(65) Prior Publication Data

US 2022/0108859 A1 Apr. 7, 2022

(30) Foreign Application Priority Data

Feb. 20, 2019 (JP) ..... 2019-028887

(51) Int. Cl.
*H01H 50/54* (2006.01)
*H01H 50/14* (2006.01)
(Continued)

(52) U.S. Cl.
CPC ..... *H01H 50/546* (2013.01); *H01H 50/14* (2013.01); *H01H 50/44* (2013.01); *H01H 50/64* (2013.01)

(58) Field of Classification Search
CPC ..... H01H 50/546; H01H 50/14; H01H 50/44; H01H 50/64; H01H 50/026; H01H 50/641; H01H 50/648
(Continued)

(56) References Cited

U.S. PATENT DOCUMENTS 5,515,019 A * 5/1996 Schedele ..... H01H 51/2272 335/130
11,735,389 B2 * 8/2023 Miyake ..... H01H 50/58 335/2
(Continued)

FOREIGN PATENT DOCUMENTS

CN 105051854 B 6/2018
JP 54-1169 U1 1/1979
(Continued)

OTHER PUBLICATIONS

International Search Report of International Application No. PCT/JP2020/005264 dated Apr. 14, 2020.
(Continued)

*Primary Examiner* — Shawki S Ismail
*Assistant Examiner* — Lisa N Homza
(74) *Attorney, Agent, or Firm* — SHINJYU GLOBAL IP

(57) ABSTRACT

First and second movable contacts are connected to a first movable contact piece. A second movable contact piece is provided separately from the first movable contact piece. Third and fourth movable contacts are connected to the second movable contact piece. A drive device moves the first movable contact piece and the second movable contact piece by moving a movable iron core by a magnetic force generated from a coil. In a state where the first to fourth movable contacts are contacts the first to fourth fixed contacts, respectively, the first movable contact piece and the second
(Continued)

movable contact piece are electrically connected in parallel with the first fixed terminal and the second fixed terminal.

13 Claims, 11 Drawing Sheets

(51) Int. Cl.
*H01H 50/44* (2006.01)
*H01H 50/64* (2006.01)

(58) Field of Classification Search
USPC ..... 335/285
See application file for complete search history.

(56) References Cited

U.S. PATENT DOCUMENTS

| | | | | |
|---|---|---|---|---|
| 2004/0027776 | A1* | 2/2004 | Uotome | H01H 51/28 361/160 |
| 2004/0066261 | A1 | 4/2004 | Nishida et al. | |
| 2010/0026427 | A1 | 2/2010 | Moeller et al. | |
| 2010/0207713 | A1 | 8/2010 | Sugisawa | |
| 2012/0075044 | A1 | 3/2012 | Sugisawa | |
| 2012/0293285 | A1 | 11/2012 | Kurihara et al. | |
| 2016/0086754 | A1 | 3/2016 | Shimoda | |
| 2016/0233039 | A1 | 8/2016 | Kanematsu et al. | |
| 2018/0240630 | A1* | 8/2018 | Kozai | H01H 50/36 |
| 2019/0066951 | A1 | 2/2019 | Kanematsu et al. | |
| 2022/0108859 | A1* | 4/2022 | Miyake | H01H 50/026 |
| 2022/0108860 | A1* | 4/2022 | Matsushima | H01H 50/64 |
| 2022/0122793 | A1* | 4/2022 | Miyake | H01H 50/045 |
| 2022/0122794 | A1* | 4/2022 | Miyake | H01H 50/54 |
| 2022/0122795 | A1* | 4/2022 | Miyake | H01H 50/045 |
| 2022/0122796 | A1* | 4/2022 | Miyake | H01H 50/20 |
| 2022/0122797 | A1* | 4/2022 | Miyake | H01H 50/641 |

FOREIGN PATENT DOCUMENTS

| | | | |
|---|---|---|---|
| JP | 2004-71512 | A | 3/2004 |
| JP | 2010-257923 | A | 11/2010 |
| JP | 2017-204480 | A | 11/2017 |
| TW | I426538 | B | 2/2014 |
| TW | I536420 | B | 6/2016 |

OTHER PUBLICATIONS

Written Opinion of the International Searching Authority of International Application No. PCT/JP2020/005264 dated Apr. 14, 2020.
The Office Action of the corresponding Taiwanese application No. 109104910 dated Jul. 20, 2021.

* cited by examiner

RELAY

CROSS-REFERENCE TO RELATED APPLICATION

This application is the U.S. National Phase of International Application No. PCT/JP2020/005264, filed on Feb. 12, 2020. This application claims priority to Japanese Patent Application No. 2019-028887, filed Feb. 20, 2019. The contents of those applications are incorporated by reference herein in their entireties.

FIELD

The present invention relates to a relay.

BACKGROUND

Some relays include a pair of fixed contacts and one movable contact piece. For example, in the relay of Japan Laid-open Patent Application Publication No. 2017-204480, the movable contact piece has a pair of movable contacts. The pair of movable contacts are arranged apart from each other in the longitudinal direction of the movable contact piece. The pair of movable contacts are respectively arranged to face the pair of fixed contacts.

SUMMARY

In a relay, contact resistance is generated between a fixed contact and a movable contact. Therefore, in the structure having two pairs of the fixed contacts and the movable contacts like the above relay, the contact resistance in the relay is high. In particular, in a high-capacity relay that opens and closes a high current, heat generation increases in proportion to the square of the current. Therefore, low contact resistance is required to suppress heat generation.

An object of the present invention is to reduce contact resistance and suppress temperature rise in a relay.

A relay according to one aspect of the present invention includes a first fixed terminal, a first fixed contact, a third fixed contact, a second fixed terminal, a second fixed contact, a fourth fixed contact, a first movable contact piece, a first movable contact, a second movable contact, a second movable contact piece, a third movable contact, a fourth movable contact, a link member, and a drive device. The first fixed contact and the third fixed contact are connected to the first fixed terminal. The second fixed contact and the fourth fixed contact are connected to the second fixed terminal. The first movable contact is connected to the first movable contact piece and faces the first fixed contact. The second movable contact is connected to the first movable contact piece and faces the second fixed contact. The second movable contact piece is provided separately from the first movable contact piece. The third movable contact is connected to the second movable contact piece and faces the third fixed contact. The fourth movable contact is connected to the second movable contact piece and faces the fourth fixed contact. The link member is connected to the first movable contact piece and the second movable contact piece. The drive device includes a coil and a movable iron core. The movable iron core is connected to the link member. The drive device moves the first movable contact piece and the second movable contact piece by moving the movable iron core by a magnetic force generated from the coil. In a state where the first to fourth movable contacts contact the first to fourth fixed contacts, respectively, the first movable contact piece and the second movable contact piece are electrically connected in parallel with the first fixed terminal and the second fixed terminal.

In the relay according to the present aspect, the first movable contact piece and the second movable contact piece are electrically connected to the first fixed terminal and the second fixed terminal in parallel with each other. Therefore, a current is divided into the first movable contact and the third movable contact. The current is divided into the second movable contact and the fourth movable contact. As a result, the contact resistance of the relay can be reduced and the temperature rise can be suppressed.

The first movable contact piece and the second movable contact piece are provided separately from each other. Therefore, as compared with a case where the first to fourth movable contacts are provided on the integrated movable contact piece, the first to fourth movable contacts can stably contacts the first to fourth fixed contacts, respectively.

The first movable contact piece may be connected to the link member between the first movable contact and the second movable contact. The second movable contact piece may be connected to the link member between the third movable contact and the fourth movable contact. In this case, the distance between the first fixed terminal and the second fixed terminal can be increased.

The link member may include a link part, a first support part, and a second support part. The link part may be connected to the movable iron core. The first support part may extend from the link part toward the first movable contact piece. The first support part may support the first movable contact piece. The second support part may extend from the link part toward the second movable contact piece. The second support part may support the second movable contact piece. In this case, the link member can stably support the first movable contact piece and the second movable contact piece.

The first movable contact piece and the second movable contact piece may extend in a first direction. The first direction may be a direction that intersects a moving direction of the first movable contact piece and the second movable contact piece. The first fixed terminal and the second fixed terminal may be arranged apart from each other in the first direction. The first movable contact piece and the second movable contact piece may be arranged apart from each other in a second direction. The second direction may be a direction that intersects the moving direction and the first direction.

The first fixed contact and the third fixed contact may be arranged apart from each other in the second direction on the first fixed terminal. The second fixed contact and the fourth fixed contact may be arranged apart from each other in the second direction on the second fixed terminal. The first fixed terminal and the second fixed terminal may extend in the second direction, respectively.

The relay may further include a housing. The housing may support the first fixed terminal and the second fixed terminal in the second direction. The first fixed terminal and the second fixed terminal may project from the housing outward of the relay in the second direction.

The link member may be supported by the housing in the second direction. In this case, by providing the first movable contact piece and the second movable contact piece separately, an operation of the link member can be stabilized even if a load on the link member is increased.

The relay may further include a first contact spring and a second contact spring. In a state where the first movable contact contacts the first fixed contact and the second movable contact contacts the second fixed contact, the first contact spring may press the first movable contact piece toward the first fixed terminal and the second fixed terminal. In a state where the third movable contact contacts the third fixed contact and the fourth movable contact contacts the fourth fixed contact, the second contact spring may press the second movable contact piece toward the first fixed terminal and the second fixed terminal. In this case, a contact pressure at each contact can be increased.

The drive device may further include a spool around which the coil is wound. At least a part of the movable iron core may be arranged in the spool. In this case, the drive device can be miniaturized.

DETAILED DESCRIPTION

Figure 1:
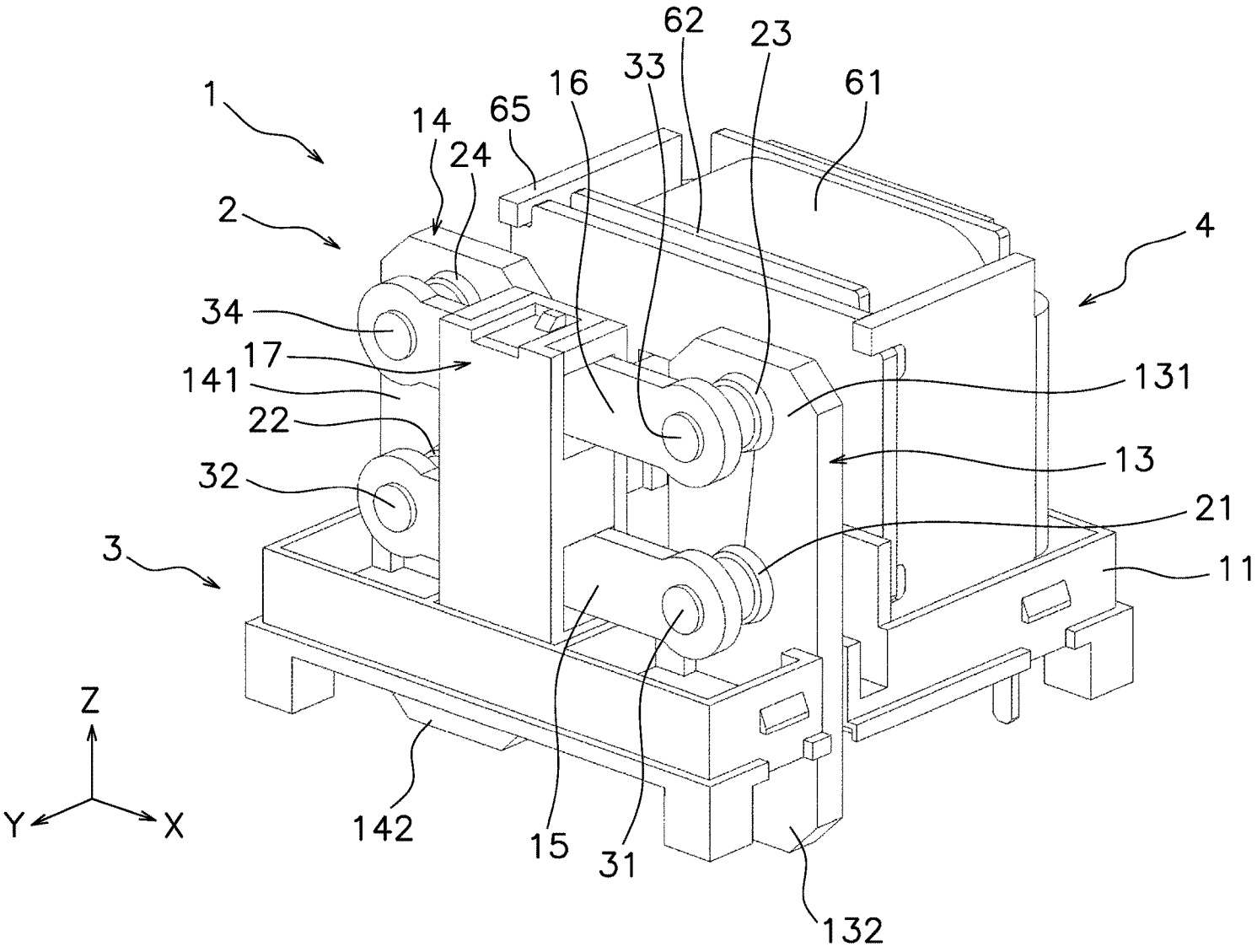
FIG. 1 is a perspective view of a relay according to an embodiment.
Figure 2:
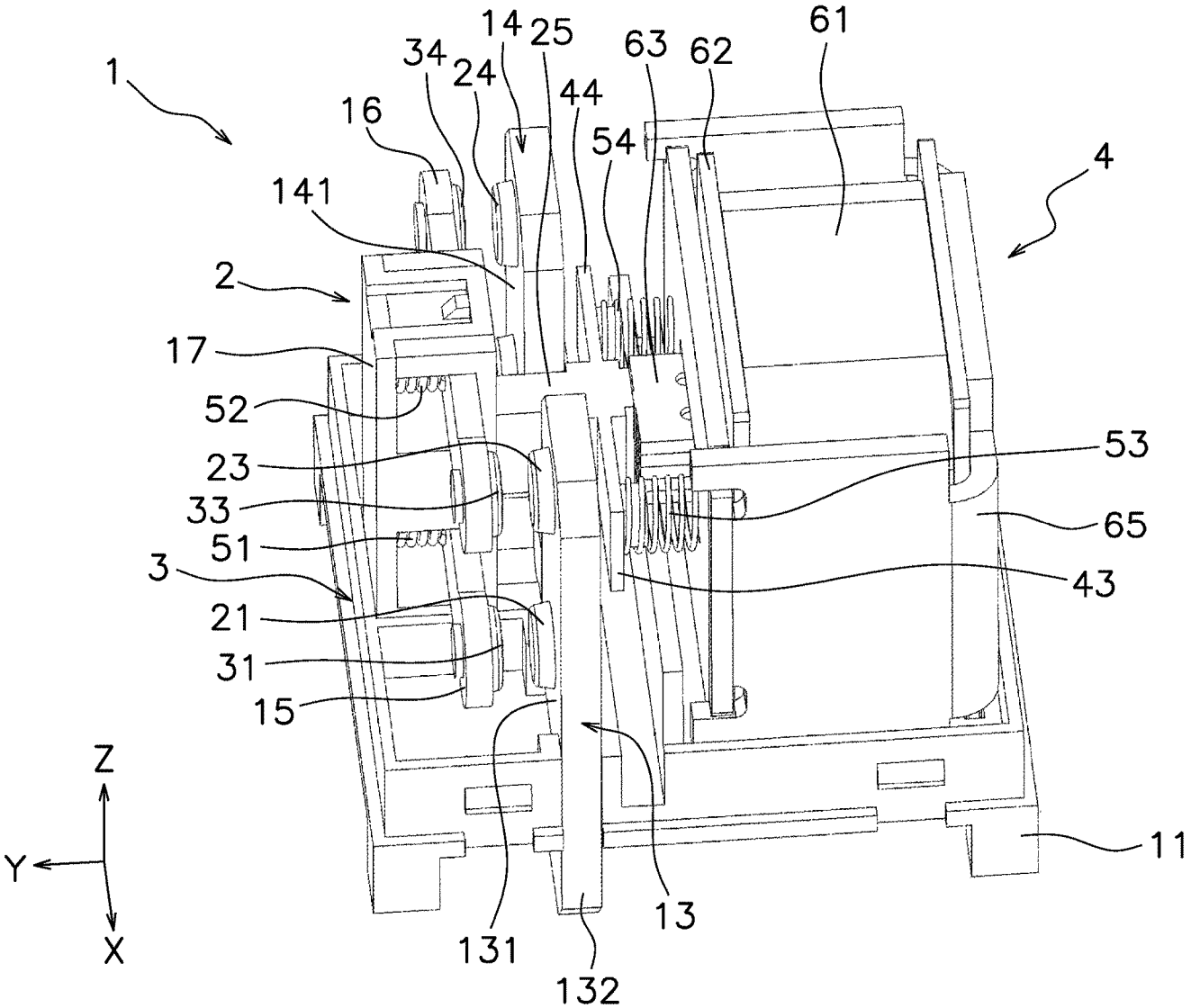
FIG. 2 is a perspective view of the relay.
Figure 3:
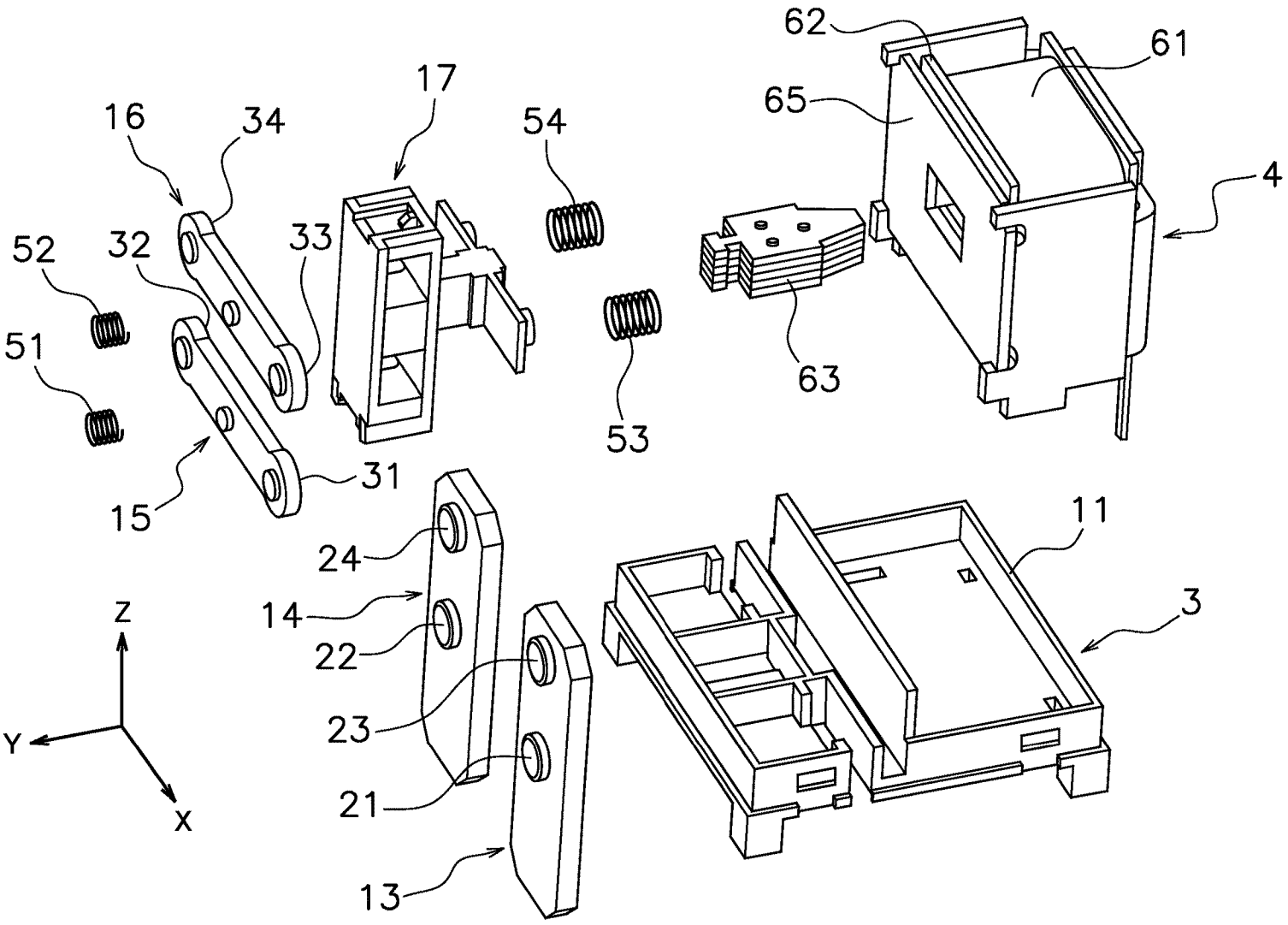
FIG. 3 is an exploded perspective view of the relay.
Figure 4:
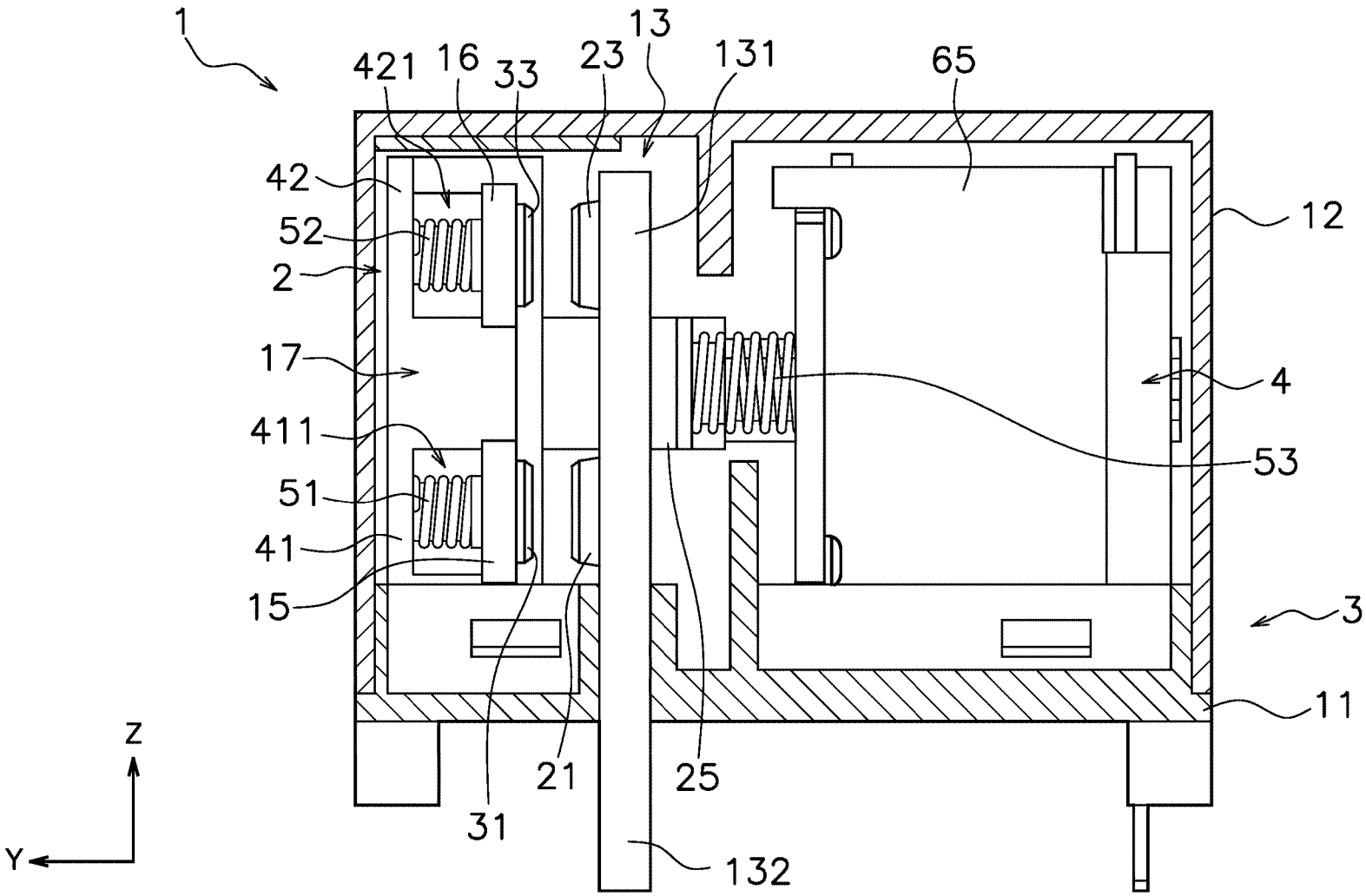
FIG. 4 is a side view of the relay.
Figure 5:
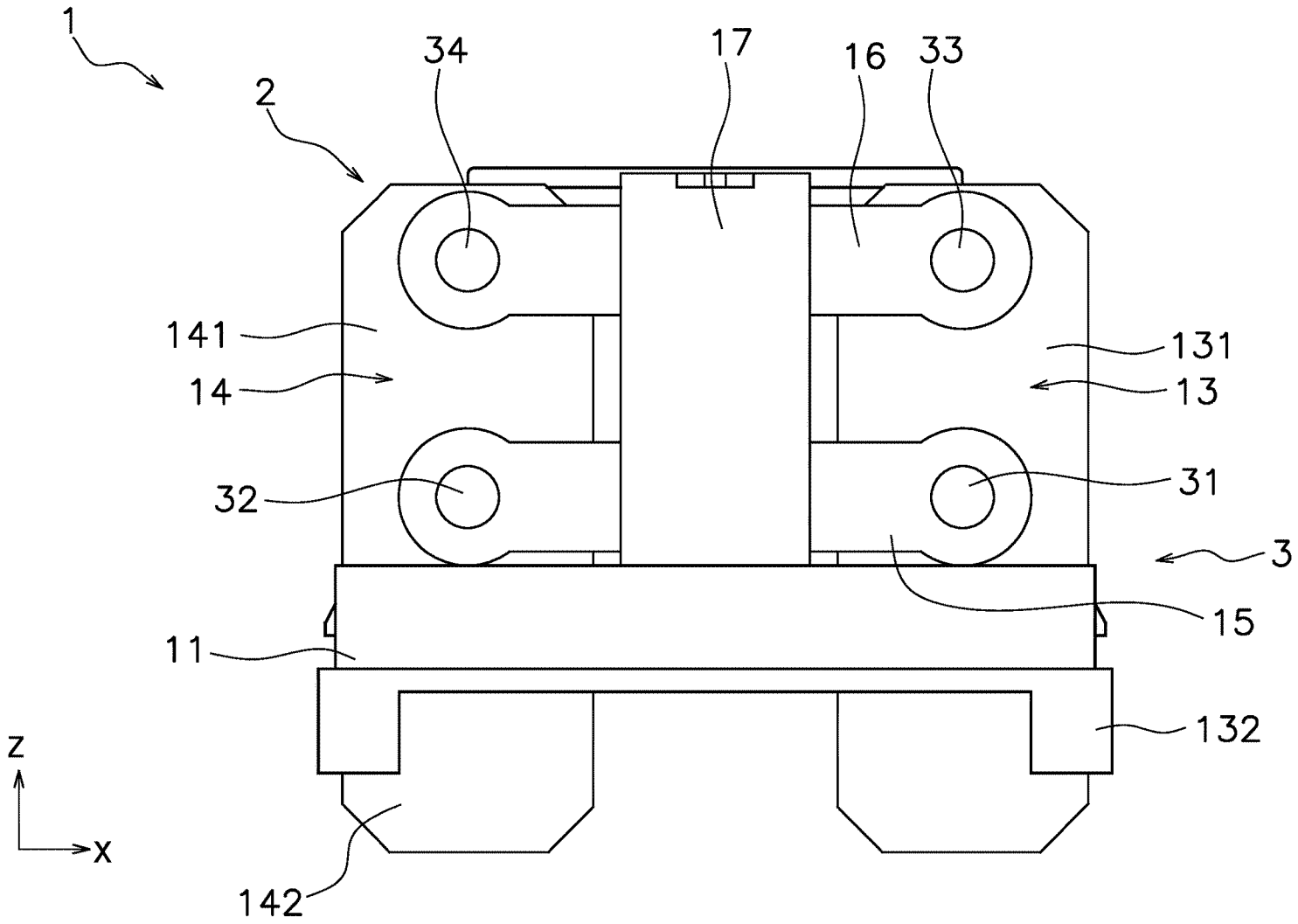
FIG. 5 is a front view of the relay.

Hereinafter, a relay 1 according to an embodiment will be described with reference to the drawings. FIGS. 1 and 2 are perspective views of the relay 1 according to the embodiment. FIG. 3 is an exploded perspective view of the relay 1. FIG. 4 is a side view of the relay 1. FIG. 5 is a front view of the relay 1.

As illustrated in FIGS. 1 to 5, the relay 1 includes a contact device 2, a housing 3, and a drive device 4. The contact device 2 and the drive device 4 are arranged in the housing 3. The housing 3 includes a base 11 and a case 12 illustrated in FIG. 4. In FIG. 4, the base 11 and the case 12 are illustrated in cross section. In FIGS. 1 to 3 and 5, the case 12 is omitted.

In the following description, a direction in which the contact device 2 and the drive device 4 are arranged with respect to the base 11 is defined as upward, and the opposite direction is defined as downward. Further, a direction that intersects the vertical direction (Z) is defined as a front-rear direction (Y). A direction that intersects the vertical direction (Z) and the front-rear direction (Y) is defined as a left-right direction (X). The left-right direction (X) is an example of the first direction. The vertical direction (Z) is an example of the second direction. However, these directions are defined for convenience of explanation, and do not limit an arrangement direction of the relay 1.

The contact device 2 includes a first fixed terminal 13, a second fixed terminal 14, a first fixed contact 21, a second fixed contact 22, a third fixed contact 23, and a fourth fixed contact 24. The first fixed terminal 13 and the second fixed terminal 14 are made of a conductive material such as copper. The first fixed terminal 13 and the second fixed terminal 14 extend in the vertical direction (Z), respectively. The first fixed terminal 13 and the second fixed terminal 14 are arranged apart from each other in the left-right direction (X). The first fixed terminal 13 and the second fixed terminal 14 are supported by the base 11.

The first fixed terminal 13 includes a first contact support portion 131 and a first outer terminal portion 132. The second fixed terminal 14 includes a second contact support portion 141 and a second outer terminal portion 142. The first contact support portion 131 and the second contact support portion 141 are arranged in the housing 3. The first outer terminal portion 132 and the second outer terminal portion 142 project outward from the housing 3. The first outer terminal portion 132 and the second outer terminal portion 142 project downward from the base 11.

The first fixed contact 21 and the third fixed contact 23 are connected to the first contact support portion 131. The first fixed contact 21 and the third fixed contact 23 are provided separately from the first fixed terminal 13. The first fixed contact 21 and the third fixed contact 23 are arranged apart from each other in the vertical direction (Z) on the first fixed terminal 13.

The second fixed contact 22 and the fourth fixed contact 24 are arranged apart from the first fixed contact 21 and the third fixed contact 23 in the left-right direction (X). The second fixed contact 22 and the fourth fixed contact 24 are connected to the second contact support portion 141. The second fixed contact 22 and the fourth fixed contact 24 are provided separately from the second fixed terminal 14. The second fixed contact 22 and the fourth fixed contact 24 are arranged apart from each other in the vertical direction (Z) at the second fixed terminal 14. The first to fourth fixed contacts 21 to 24 are made of a conductive material such as silver or copper.

The contact device 2 includes a first movable contact piece 15, a second movable contact piece 16, a first movable contact 31, a second movable contact 32, a third movable contact 33, and a fourth movable contact 34. The first movable contact piece 15 and the second movable contact piece 16 extend in the left-right direction (X). The longitudinal direction of the first movable contact piece 15 and the second movable contact piece 16 coincides with the left-right direction (X). The first movable contact piece 15 and the second movable contact piece 16 are provided separately from each other. The first movable contact piece 15 and the second movable contact piece 16 are arranged apart from each other in the vertical direction (Z).

The second movable contact piece 16 is arranged above the first movable contact piece 15. The first movable contact piece 15 is arranged between the second movable contact piece 16 and the base 11 in the vertical direction. The first movable contact piece 15 and the second movable contact piece 16 are arranged to face the first contact support portion 131 of the first fixed terminal 13 and the second contact support portion 141 of the second fixed terminal 14 in the front-rear direction (Y). The first movable contact piece 15 and the second movable contact piece 16 are made of a conductive material such as copper.

The first movable contact 31 and the second movable contact 32 are provided separately from the first movable contact piece 15. The first movable contact 31 and the second movable contact 32 are connected to the first movable contact piece 15. The first movable contact 31 and the second movable contact 32 are arranged apart from each other in the left-right direction (X). The first movable contact 31 is arranged to face the first fixed contact 21. The second movable contact 32 is arranged to face the second fixed contact 22.

The third movable contact 33 and the fourth movable contact 34 are provided separately from the second movable contact piece 16. The third movable contact 33 and the fourth movable contact 34 are connected to the second movable contact piece 16. The third movable contact 33 and the fourth movable contact 34 are arranged apart from each other in the left-right direction (X). The third movable contact 33 is arranged apart from the first movable contact 31 in the vertical direction (Z). The fourth movable contact 34 is arranged apart from the second movable contact 32 in the vertical direction (Z). The third movable contact 33 is arranged to face the third fixed contact 23. The fourth movable contact 34 is arranged to face the fourth fixed contact 24. The first to fourth movable contacts 31 to 34 are made of a conductive material such as silver or copper.

The contact device 2 includes a link member 17. The link member 17 is connected to the first movable contact piece 15 and the second movable contact piece 16. The first movable contact piece 15 is connected to the link member 17 between the first movable contact 31 and the second movable contact 32. The second movable contact piece 16 is connected to the link member 17 between the third movable contact 33 and the fourth movable contact 34. The link member 17 is made of an insulating material such as resin.

Figure 6:
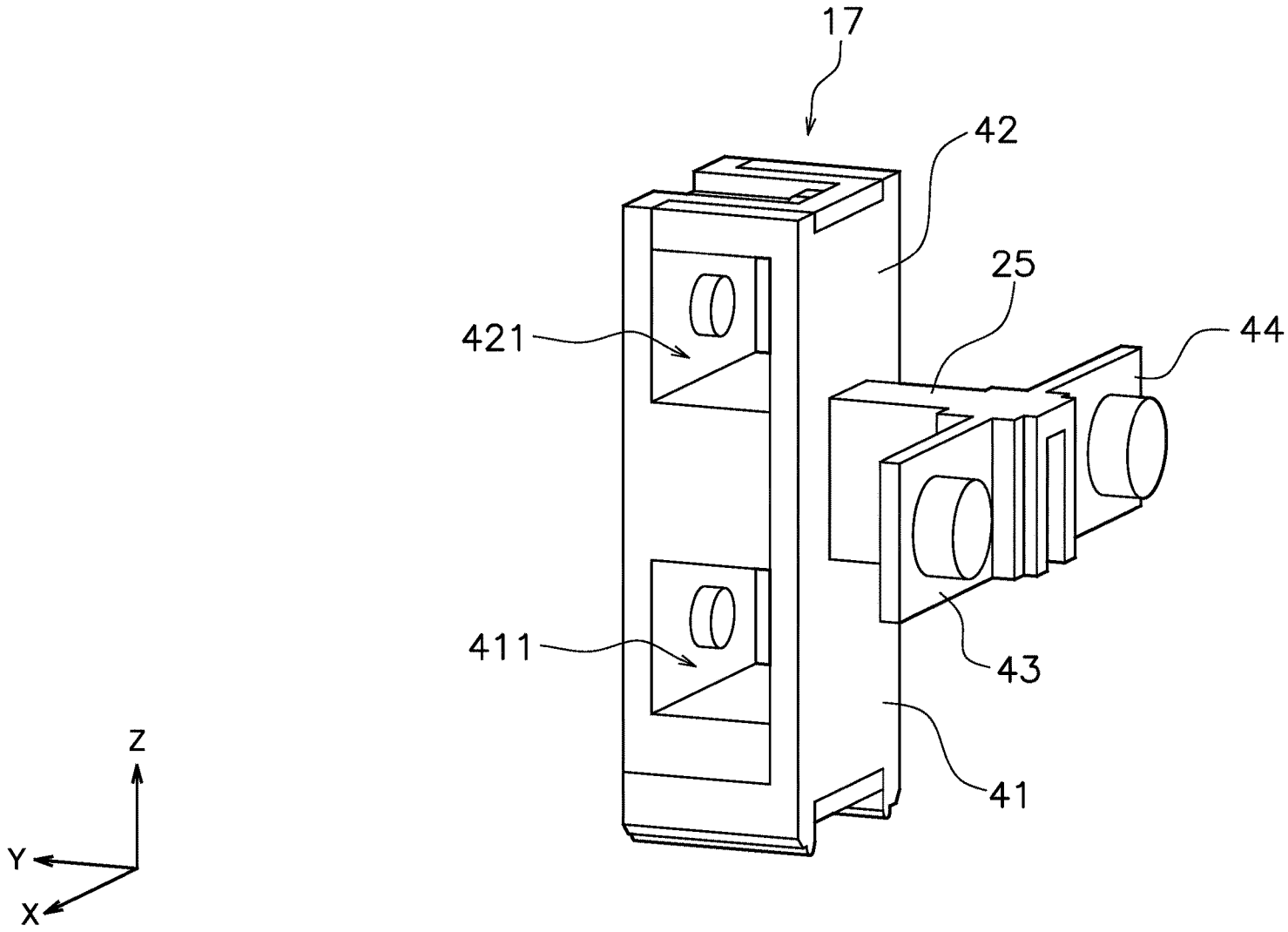
FIG. 6 is an enlarged view of a link member.

In detail, FIG. 6 is an enlarged view of the link member 17. As illustrated in FIG. 6, the link member 17 includes a link part 25, a first support part 41, a second support part 42, a first connection part 43, and a second connection part 44. The link part 25 extends in the front-rear direction (Y). The first support part 41 extends downward from the link part 25. The first support part 41 supports the first movable contact piece 15. The first support part 41 includes a first support hole 411. The first movable contact piece 15 is arranged in the first support hole 411.

The second support part 42 extends upward from the link part 25. The second support part 42 supports the second movable contact piece 16. The second support part 42 includes a second support hole 421. The second movable contact piece 16 is arranged in the second support hole 421.

As illustrated in FIG. 4, an upper end of the link member 17 is arranged close to the case 12. A lower end of the link member 17 is arranged on the base 11. The link member 17 is supported by the base 11 in the vertical direction (Z).

The contact device 2 includes a first contact spring 51 and a second contact spring 52. The first contact spring 51 is arranged between the first movable contact piece 15 and the first support part 41. The first contact spring 51 is arranged in the first support hole 411. In a state where the first movable contact 31 contacts the first fixed contact 21 and the second movable contact 32 contacts the second fixed contact 22, the first contact spring 51 presses the first movable contact piece 15 toward the first fixed terminal 13 and the second fixed terminal 14.

The second contact spring 52 is arranged between the second movable contact piece 16 and the second support part 42. The second contact spring 52 is arranged in the second support hole 421. In a state where the third movable contact 33 contacts the third fixed contact 23 and the fourth movable contact 34 contacts the fourth fixed contact 24, the second contact spring 52 presses the second movable contact piece 16 toward the first fixed terminal 13 and the second fixed terminal 14.

Figure 7:
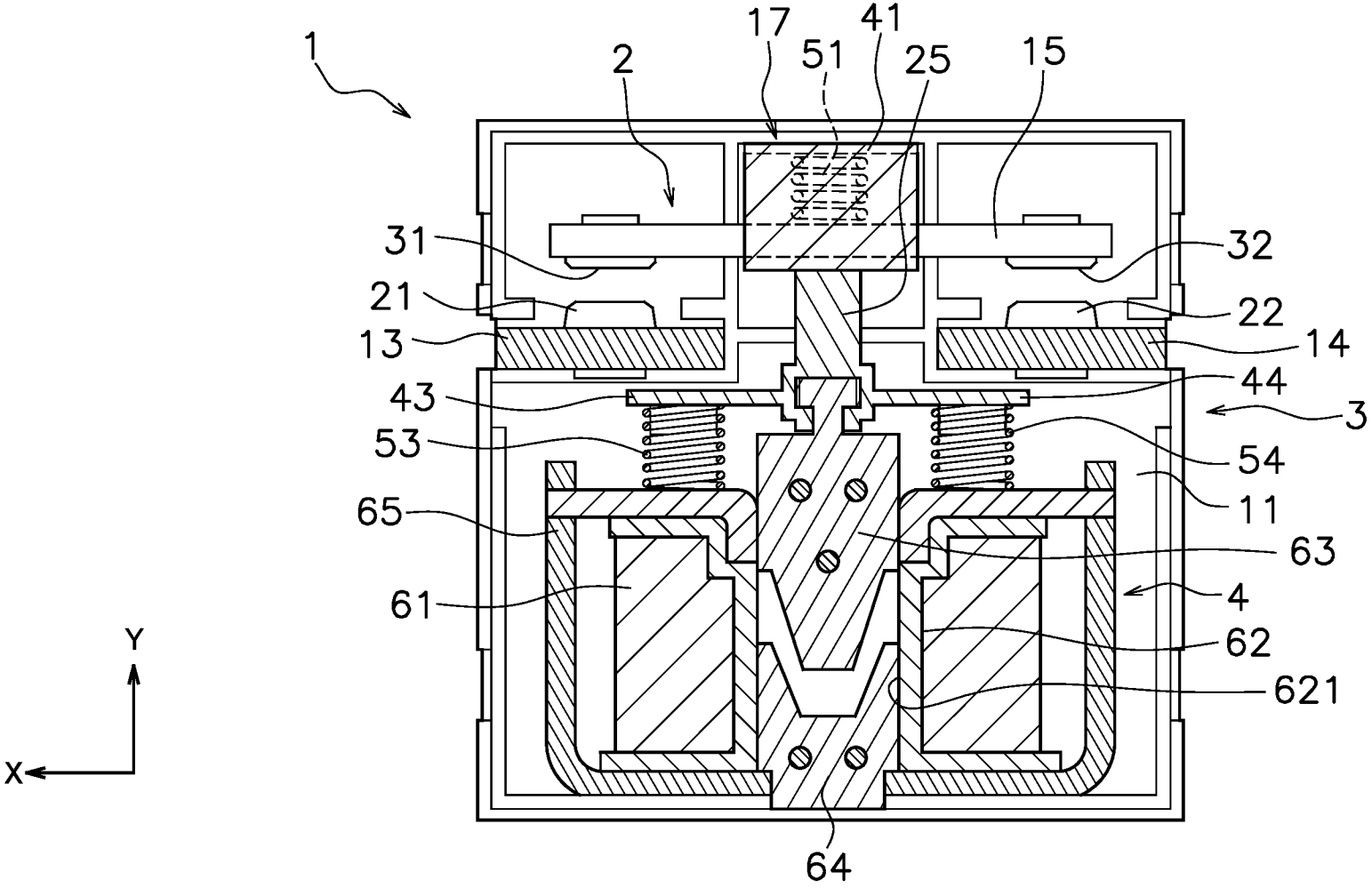
FIG. 7 is a top sectional view of the relay.
Figure 8:
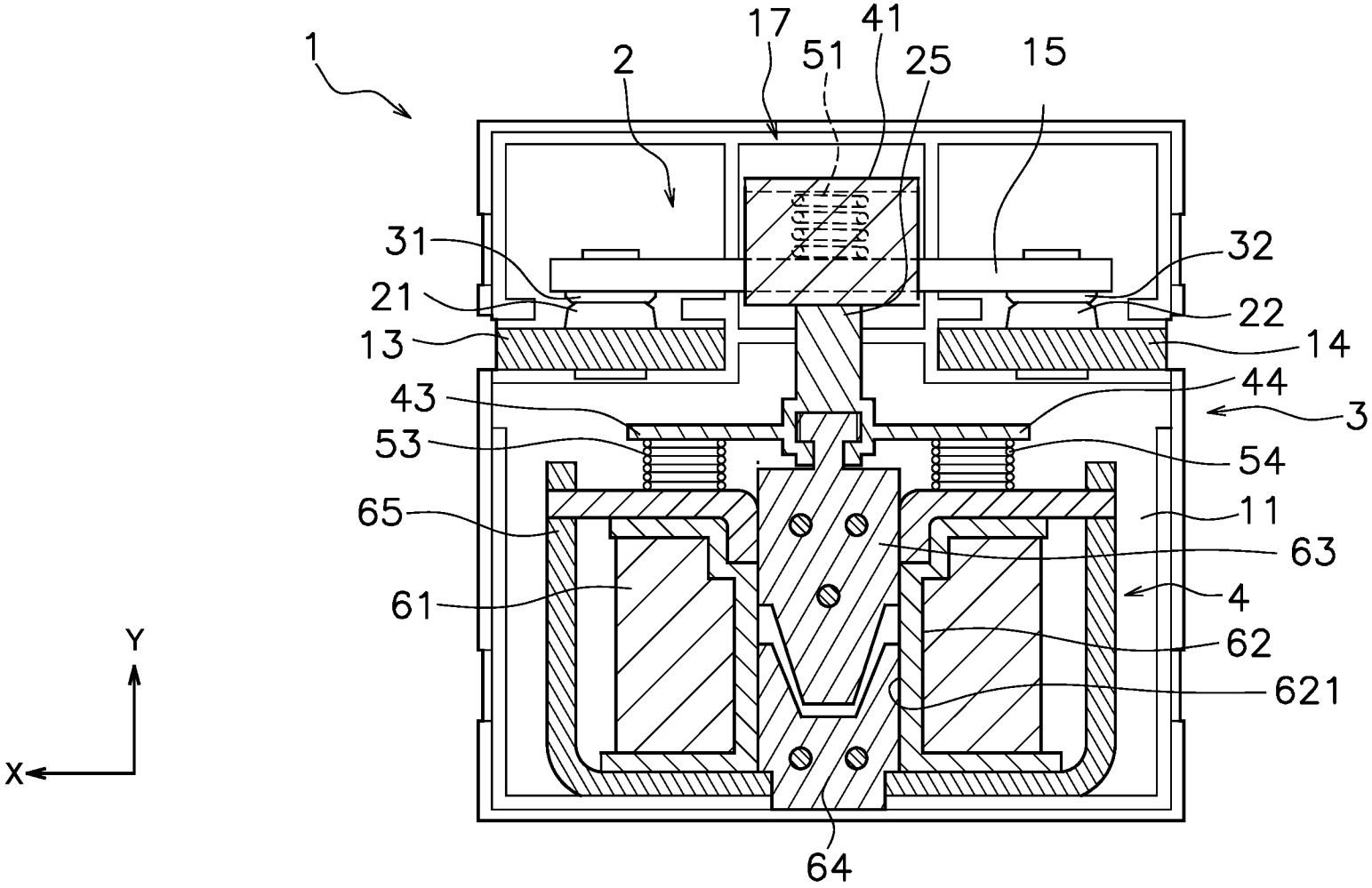
FIG. 8 is a top sectional view of the relay.

FIGS. 7 and 8 are top sectional views of the relay 1. The drive device 4 operates the first movable contact piece 15 and the second movable contact piece 16 by an electromagnetic force. The drive device 4 operates the first movable contact piece 15 and the second movable contact piece 16 in a contact direction and an opening direction. The contact direction is a direction in which the movable contacts 31 to 34 approach the fixed contacts 21 to 24 in the front-rear direction (Y). The opening direction is a direction in which the movable contacts 31 to 34 are separated from the fixed contacts 21 to 24 in the front-rear direction (Y). The drive device 4 includes a coil 61, a spool 62, a movable iron core 63, a fixed iron core 64, and a yoke 65.

The coil 61 is wound around the spool 62. An axis of the coil 61 extends in the front-rear direction (Y). The spool 62 includes a hole 621 extending in an axial direction of the coil 61. At least a part of the movable iron core 63 is arranged in the hole 621 of the spool 62. The movable iron core 63 is connected to the link member 17. The movable iron core 63 is configured to move in the contact direction and the opening direction. The fixed iron core 64 is arranged in the hole 621 of the spool 62. The fixed iron core 64 is arranged to face the movable iron core 63 in the front-rear direction (Y). The coil 61 generates an electromagnetic force that moves the movable iron core 63 in the contact direction when energized. The yoke 65 is arranged so as to surround the coil 61. The yoke 65 is arranged on a magnetic circuit generated by the coil 61. The yoke 65 is arranged in front of, behind, to the left, and to the right of the coil 61.

The relay 1 includes a first return spring 53 and a second return spring 54. The first return spring 53 and the second return spring 54 are arranged between the link member 17 and the drive device 4. The first return spring 53 is connected to the first connection part 43 of the link member 17. The second return spring 54 is connected to the second connection part 44 of the link member 17. The first return spring 53 and the second return spring 54 urge the movable iron core 63 in the opening direction.

Next, an operation of the relay 1 will be described. When the coil 61 is not energized, the drive device 4 is not magnetized. In this case, the link member 17 is pressed together with the movable iron core 63 in the opening direction by the elastic force of the return springs 53 and 54. Therefore, the link member 17 is located at the open position illustrated in FIG. 1. In this state, the first movable contact piece 15 and the second movable contact piece 16 are also pressed in the opening direction via the link member 17. Therefore, the link member 17 is in the open position, and the first movable contact 31 and the second movable contact 32 are separated from the first fixed contact 21 and the second fixed contact 22. Similarly, the link member 17 is located at the open position, and the third movable contact 33 and the fourth movable contact 34 are separated from the third fixed contact 23 and the fourth fixed contact 24.

When the coil 61 is energized, the drive device 4 is magnetized. In this case, due to the electromagnetic force of the coil 61, the movable iron core 63 moves in the contact direction against the elastic force of the return springs 53 and 54. As a result, the link member 17, the first movable contact piece 15, and the second movable contact piece 16 move in the contact direction. Therefore, as illustrated in FIG. 8, the link member 17 moves to the closed position. As a result, the link member 17 is located at the closed position, and the first movable contact 31 and the second movable contact 32 contact the first fixed contact 21 and the second fixed contact 22, respectively. Similarly, when the link member 17 is located at the closed position, the third movable contact 33 and the fourth movable contact 34 contact the third fixed contact 23 and the fourth fixed contact 24, respectively. As a result, the first movable contact piece 15 and the second movable contact piece 16 are electrically connected to the first fixed terminal 13 and the second fixed terminal 14 in parallel with each other.

When the current to the coil 61 is stopped and degaussed, the movable iron core 63 is pressed in the opening direction by the elastic force of the return springs 53 and 54. As a result, the link member 17, the first movable contact piece 15, and the second movable contact piece 16 move in the opening direction. Therefore, as illustrated in FIG. 7, the link member 17 moves to the open position. As a result, the link member 17 is located in the open position, and the first movable contact 31 and the second movable contact 32 are separated from the first fixed contact 21 and the second fixed contact 22. Similarly, when the link member 17 is located in the open position, the third movable contact 33 and the fourth movable contact 34 are separated from the third fixed contact 23 and the fourth fixed contact 24.

In the relay 1 according to the present embodiment described above, the first movable contact piece 15 and the second movable contact piece 16 are electrically connected to the first fixed terminal 13 and the second fixed terminal 14 in parallel with each other. Therefore, the current is divided into the first movable contact 31 and the third movable contact 33. The current is divided into the second movable contact 32 and the fourth movable contact 34. Thereby, the contact resistance of the relay 1 can be reduced.

The first movable contact piece 15 and the second movable contact piece 16 are provided separately from each other. Therefore, as compared with the case where the first to fourth movable contacts 31 to 34 are provided on an integrated movable contact piece, the first to fourth movable contacts 31 to 34 are stably connected to the first to fourth fixed contacts 21 to 24, respectively.

Although one embodiment of the present invention has been described above, the present invention is not limited to the above embodiment, and various modifications can be made without departing from the gist of the invention.

In the above embodiment, the drive device 4 pushes the link member 17 from the drive device 4 toward the contact device 2, so that the first movable contact piece 15 and the second movable contact piece 16 move in the opening direction. Further, when the drive device 4 pulls the link member 17 from the contact device 2 toward the drive device 4, the first movable contact piece 15 and the second movable contact piece 16 move in the contact direction. However, the operating direction of the link member 17 for opening and closing the contacts may be opposite to that of the above embodiment. That is, the drive device 4 may push the link member 17 from the drive device 4 toward the contact device 2 to move the first movable contact piece 15 and the second movable contact piece 16 in the contact direction. The drive device 4 may pull the link member 17 from the contact device 2 to the drive device 4 to move the first movable contact piece 15 and the second movable contact piece 16 in the opening direction. That is, the contact direction and the opening direction may be opposite to those of the above embodiment.

The shapes or arrangements of the first fixed terminal 13, the second fixed terminal 14, the first movable contact piece 15, and the second movable contact piece 16 may be changed. For example, the first outer terminal portion 132 and the second outer terminal portion 142 may protrude from the base 11 in a direction different from that of the above embodiment. The shapes or arrangements of the first to fourth fixed contacts 21 to 24 may be changed. For example, the first fixed contact 21 and the third fixed contact 23 may be arranged apart from each other in the left-right direction (X). The second fixed contact 22 and the fourth fixed contact 24 may be arranged apart from each other in the left-right direction (X). The same applies to the first to fourth movable contacts 31 to 34.

The shapes or arrangements of the coil 61, the spool 62, the movable iron core 63, the fixed iron core 64, or the yoke 65 may be changed. The shapes or arrangements of the first to fourth fixed contacts 21 to 24 may be changed. The shapes or arrangements of the first to fourth movable contacts 31 to 34 may be changed. In the above embodiment, the relay 1 includes a first return spring 53 and a second return spring 54. However, the number of return springs may be one or more than two.

The first fixed contact 21 and/or the third fixed contact 23 may be integrated with the first fixed terminal 13. The first fixed contact 21 and/or the third fixed contact 23 may be a part of the first fixed terminal 13 and may be flush with the other part of the first fixed terminal 13. The second fixed contact 22 and/or the fourth fixed contact 24 may be integrated with the second fixed terminal 14. The second fixed contact 22 and/or the fourth fixed contact 24 may be a part of the second fixed terminal 14 and may be flush with the other part of the second fixed terminal 14.

The first movable contact 31 and/or the second movable contact 32 may be integrated with the first movable contact piece 15. The first movable contact 31 and/or the second movable contact 32 may be a part of the first movable contact piece 15 and may be flush with the other part of the first movable contact piece 15. The third movable contact 33 and/or the fourth movable contact 34 may be integrated with the second movable contact piece 16. The third movable contact 33 and/or the fourth movable contact 34 may be a part of the second movable contact piece 16 and may be flush with the other part of the second movable contact piece 16.

Figure 9:
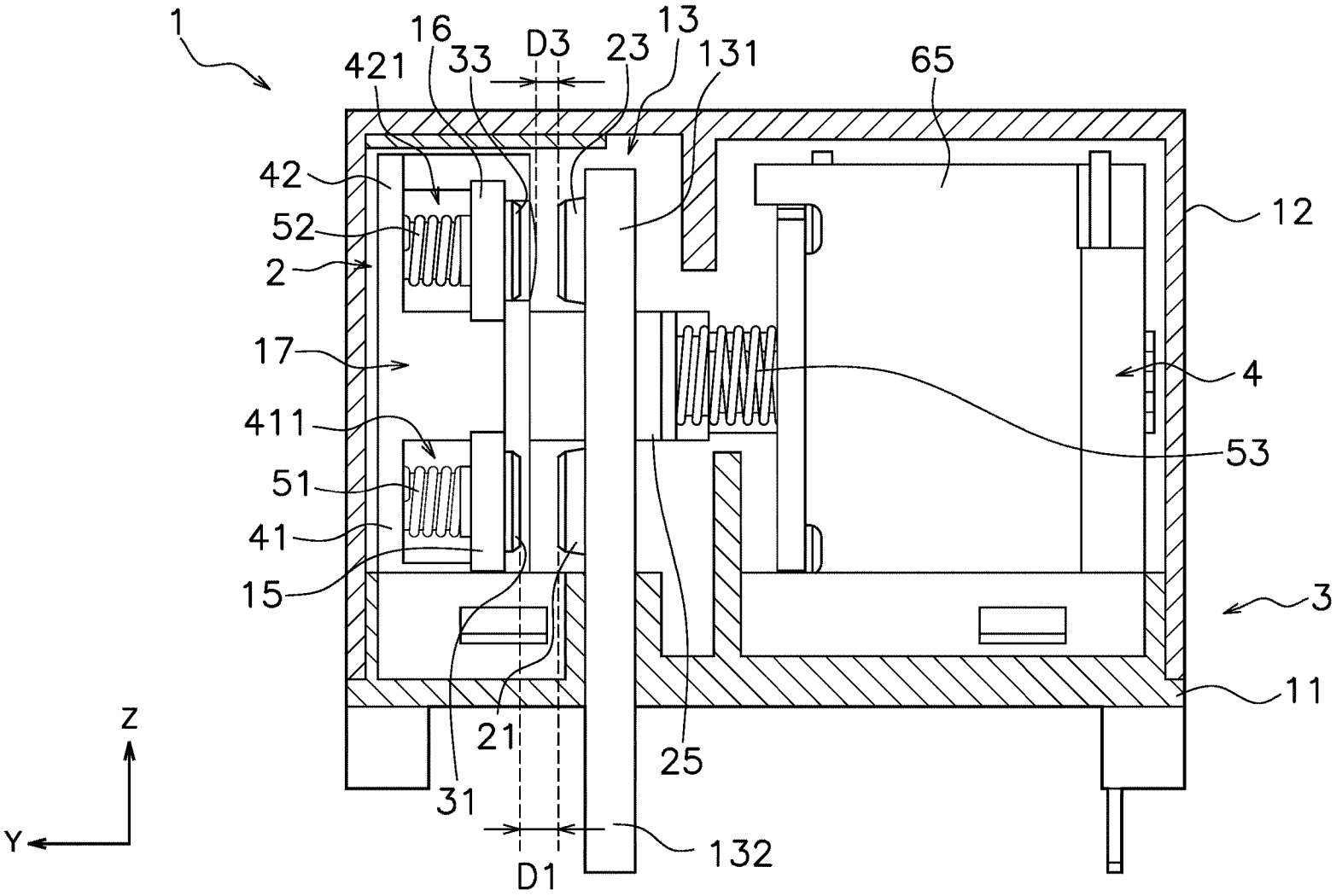
FIG. 9 is a side view of the relay according to a first modification.

In the above embodiment, a distance between the first movable contact 31 and the first fixed contact 21 and a distance between the third movable contact 33 and the third fixed contact 23 are substantially the same. Therefore, the third movable contact 33 and the third fixed contact 23 contact each other substantially at the same time as the contact between the first movable contact 31 and the first fixed contact 21. However, as in the first modification illustrated in FIG. 9, the distance D1 between the first movable contact 31 and the first fixed contact 21 and the distance D3 between the third movable contact 33 and the third fixed contact 23 may be different. Thereby, the opening/closing contacts for generating an arc and the energizing contacts can be separated. The same applies to the second and fourth movable contacts 32 and 34 and the second and fourth fixed contacts 22 and 24.

Figure 10:
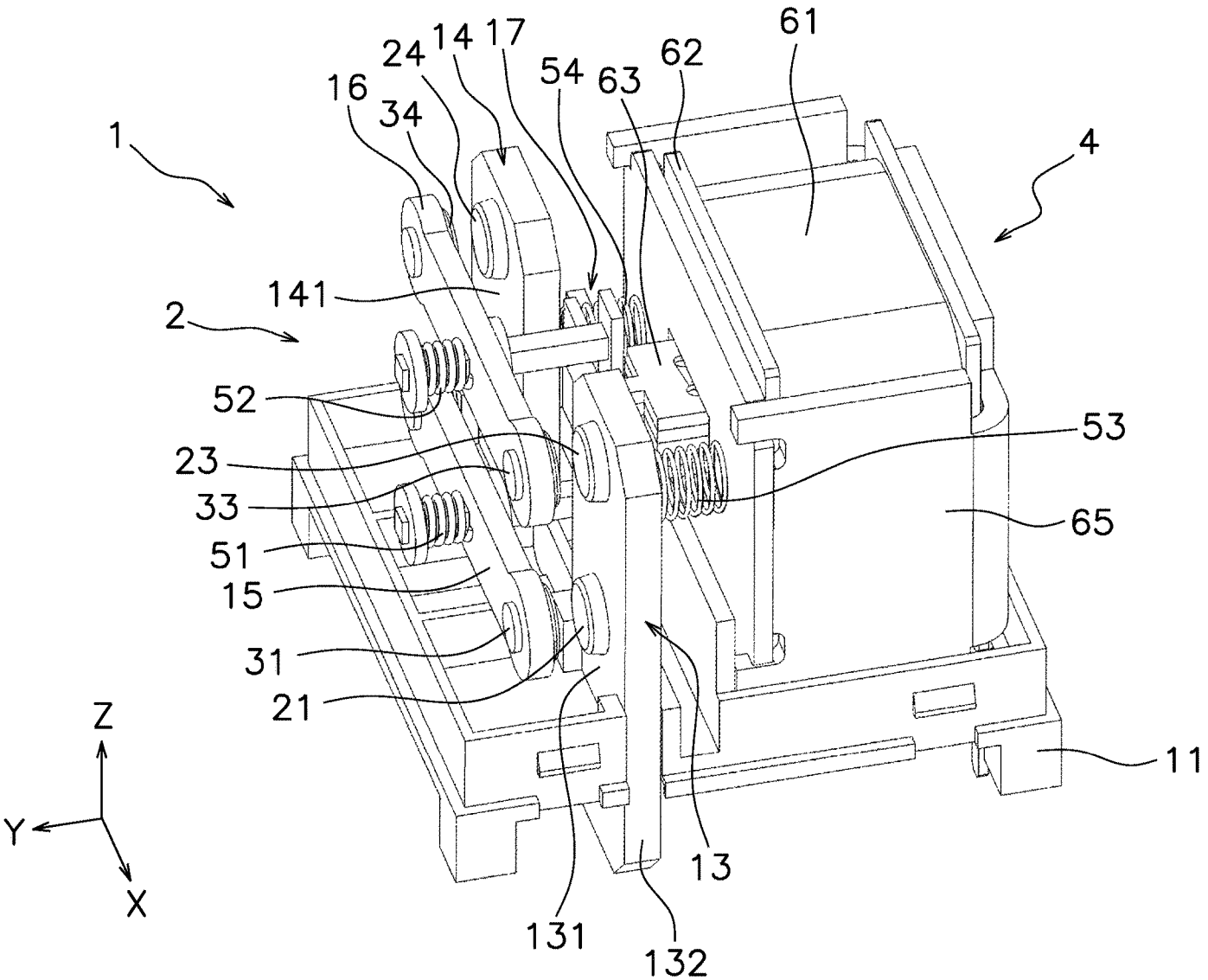
FIG. 10 is a perspective view of the relay according to a second modification.
Figure 11:
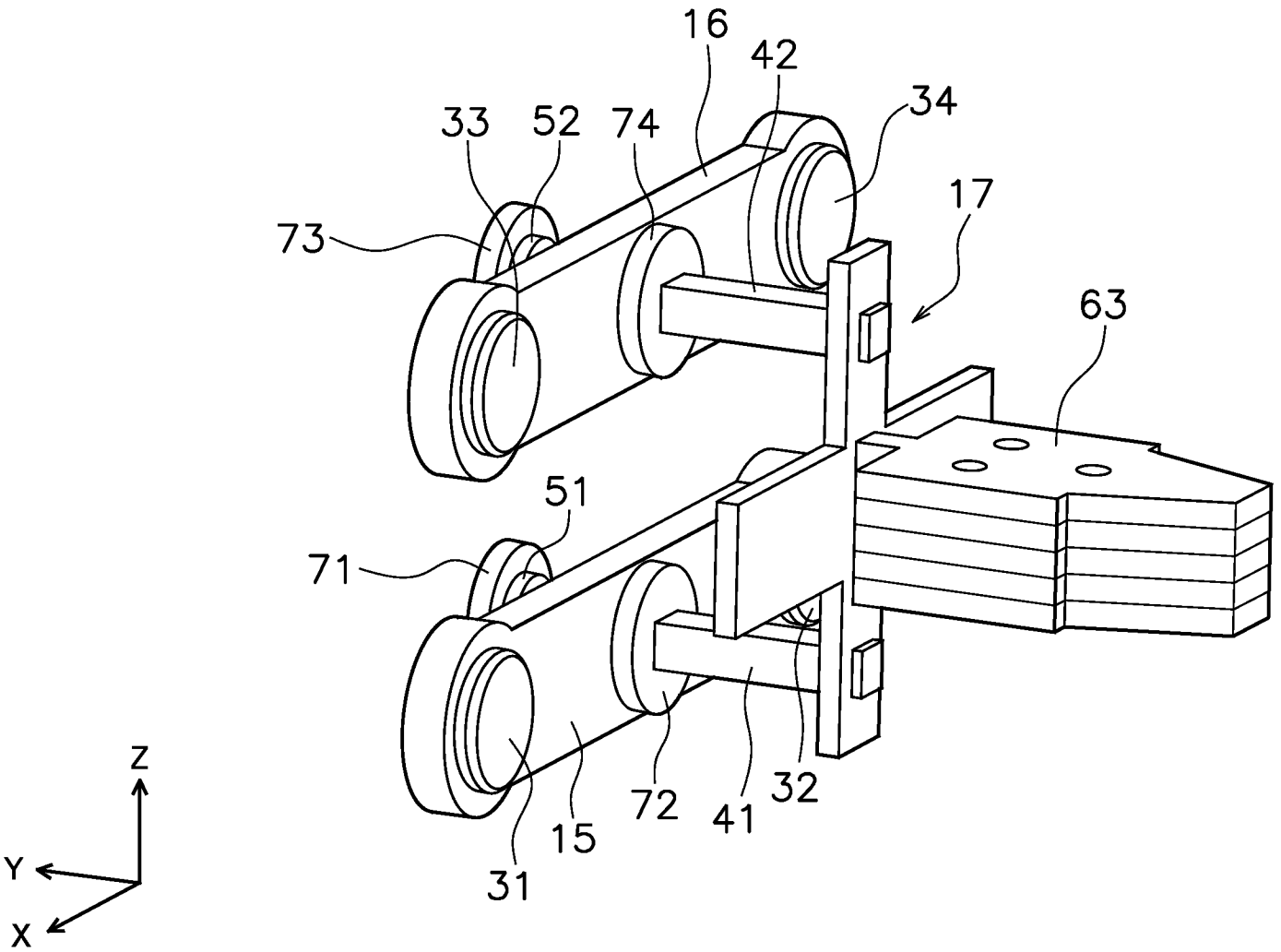
FIG. 11 is a perspective view of the link member according to the second modification.

The link member 17 does not have to be supported by the housing 3. The link member 17 may be made of a conductive material. The link member 17 may be made of metal. The shape or arrangement of the link member 17 may be changed. For example, FIG. 10 is a diagram showing a relay 1 according to a second modification. FIG. 11 is a diagram showing a link member 17 according to the second modification.

As illustrated in FIGS. 10 and 11, the shapes of the first support part 41 and the second support part 42 may be changed. The first support part 41 may be provided so as to penetrate the first movable contact piece 15. The first support part 41 may include stoppers 71 and 72. The first movable contact piece 15 and the first contact spring 51 may be arranged between the stoppers 71 and 72.

The second support part 42 may be provided so as to penetrate the second movable contact piece 16. The second support part 42 may include stoppers 73 and 74. The second movable contact piece 16 and the second contact spring 52 may be arranged between the stoppers 73 and 74.

REFERENCE SIGNS LIST

3: Housing, 4: Drive device, 13: First fixed terminal, 14: Second fixed terminal, 15: First movable contact piece, 16: Second movable contact piece, 17: Link member, 21: First fixed contact, 22: Second fixed contact, 23: Third fixed contact, 24: Fourth fixed contact, 25: Link part, 31: First movable contact, 32: Second movable contact, 33: Third movable contact, 34: Fourth movable contact, 41: First support part, 42: Second support part, 51: First contact spring, 52: Second contact spring, 61: Coil, 62: Spool, 63: Movable iron core

The invention claimed is:

1. A relay comprising:

a first fixed terminal;

a first fixed contact connected to the first fixed terminal;

a third fixed contact connected to the first fixed terminal;

a second fixed terminal;

a second fixed contact connected to the second fixed terminal;

a fourth fixed contact connected to the second fixed terminal;

a first movable contact piece;

a first movable contact that faces the first fixed contact, the first movable contact being connected to the first movable contact piece;

a second movable contact that faces the second fixed contact, the second movable contact being connected to the first movable contact piece;

a second movable contact piece provided separately from the first movable contact piece;

a third movable contact that faces the third fixed contact, the third movable contact being connected to the second movable contact piece;

a fourth movable contact that faces the fourth fixed contact, the fourth movable contact being connected to the second movable contact piece;

a link member connected to the first movable contact piece and the second movable contact piece; and a drive device including a coil and a movable iron core connected to the link member, the drive device being configured to move the first movable contact piece and the second movable contact piece by moving the movable iron core by a magnetic force generated from the coil, wherein in a state where the first to fourth movable contacts contact the first to fourth fixed contacts, respectively, the first movable contact piece and the second movable contact piece are electrically connected in parallel with the first fixed terminal and the second fixed terminal.

2. The relay according to claim 1, wherein the first movable contact piece is connected to the link member between the first movable contact and the second movable contact, and the second movable contact piece is connected to the link member between the third movable contact and the fourth movable contact.

3. The relay according to claim 1, wherein the link member includes a link part connected to the movable iron core, a first support part extending from the link part toward the first movable contact piece, the first support part configured to support the first movable contact piece, and a second support part extending from the link part toward the second movable contact piece, the second support part configured to support the second movable contact piece.

4. The relay according to claim 1, wherein the first movable contact piece and the second movable contact piece extend in a first direction that intersects a moving direction of the first movable contact piece and the second movable contact piece.

5. The relay according to claim 4, wherein the first fixed terminal and the second fixed terminal are arranged apart from each other in the first direction.

6. The relay according to claim 4, wherein the first movable contact piece and the second movable contact piece are arranged apart from each other in a second direction that intersects the moving direction and the first direction.

7. The relay according to claim 6, wherein the first fixed contact and the third fixed contact are arranged apart from each other in the second direction on the first fixed terminal, and the second fixed contact and the fourth fixed contact are arranged apart from each other in the second direction on the second fixed terminal.

8. The relay according to claim 6, wherein the first fixed terminal and the second fixed terminal extend in the second direction, respectively.

9. The relay according to claim 6, further comprising:

a housing configured to support the first fixed terminal and the second fixed terminal in the second direction.

10. The relay according to claim 9, wherein the first fixed terminal and the second fixed terminal project from the housing outward of the relay in the second direction.

11. The relay according to claim 9, wherein the link member is supported by the housing in the second direction.

12. The relay according to claim 1, further comprising:

a first contact spring configured to press the first movable contact piece toward the first fixed terminal and the second fixed terminal in a state where the first movable contact contacts the first fixed contact and the second movable contact contacts the second fixed contact; and a second contact spring configured to press the second movable contact piece toward the first fixed terminal and the second fixed terminal in a state where the third movable contact contacts the third fixed contact and the fourth movable contact contacts the fourth fixed contact.

13. The relay according to claim 1, wherein the drive device further includes a spool around which the coil is wound, and at least a part of the movable iron core is disposed in the spool.

* * * * *